US006152759A

United States Patent [19]

Daoud et al.

[11] Patent Number: 6,152,759

[45] Date of Patent: Nov. 28, 2000

[54] STRAIN RELIEF MECHANISM FOR AN INSULATION DISPLACEMENT CONNECTOR

[75] Inventors: Bassel H. Daoud, Parsippany; Christopher M. Helmstetter, Bridgewater; Antonio A. Figueiredo, Long Valley; Jason A. Kay, Morristown; Walter Pelosi, Randolph, all of N.J.

[73] Assignee: Lucent Technologies Inc., Murray Hill, N.J.

[21] Appl. No.: 09/217,772

[22] Filed: Dec. 21, 1998

[51] Int. Cl.[7] ..... H01R 4/24

[52] U.S. Cl. ..... 439/409

[58] Field of Search ..... 439/410, 409, 439/403, 399, 942, 404

[56] References Cited

U.S. PATENT DOCUMENTS

| | | | |
|---|---|---|---|
| 3,611,264 | 10/1971 | Ellis | 439/409 |
| 4,426,125 | 1/1984 | Crawford | 439/409 |
| 4,684,195 | 8/1987 | Anderson et al. | 439/409 |
| 6,045,392 | 4/2000 | Daoud | 439/409 |

FOREIGN PATENT DOCUMENTS

| | | | |
|---|---|---|---|
| 274948 | 12/1987 | European Pat. Off. | 4/24 |

*Primary Examiner*—Neil Abrams
*Assistant Examiner*—J. F. Duverne
*Attorney, Agent, or Firm*—Stroock & Stroock & Lavan LLP

[57] ABSTRACT

A strain relief for an insulation displacement connector contains a cap section and a base section connected to the cap section at a pivot point. The cap section has at least one wire insertion channel and a first wall. The wire insertion channel has an entrance aperture which is in fluid communication with an exit aperture for passage therethrough in an insertion of an inserted wire. The exit aperture is contained in the first wall. The cap section is pivotally moveable between an open position which facilitates insertion of the wire into the cap section through the entrance aperture and out through the exit aperture, and a closed position. The base section has a side wall and a base hole or depression formed in the base section at the foot of the side wall. The base hole includes a wire stop portion at its bottom. The base hole is disposed such that passage of the inserted wire out through the exit aperture into the open portion of the base hole is limited by abutment against the wire stop portion at the bottom of the base hole. In this orientation, the wire is retained in the base hole at a first orientation which is substantially parallel to the insertion direction of the inserted wire. When the cap is moved into the closed position, the first wall of the cap section forces the wire into contact with the side wall so as to cause the wire to be bent and thus oriented at a wire bend angle in a second orientation. In this second orientation, the wire is restrained in the connector as a result of this forced bend and thereby is strain relieved.

26 Claims, 3 Drawing Sheets

STRAIN RELIEF MECHANISM FOR AN INSULATION DISPLACEMENT CONNECTOR

FIELD OF THE INVENTION

This invention relates generally to the field of telephone wire connectors and distribution systems, and specifically to a strain relief mechanism for an insulation displacement connector (IDC).

BACKGROUND OF INVENTION

Telephone lines, which are carried by electrical conductors known as tip ring wire pairs, are generally aggregated at a particular point in a building prior to being distributed and connected to various types of telephone equipment, such as, for example, telephones, fax machines, modems etc. As the tip ring pairs generally enter the building as part of a multi-conductor cable, the individual tip ring wire pairs must first be broken out from the cable into individual wire pairs. This is normally accomplished in a junction box known as, for example, a building entrance protector (BEP), or network interface unit (NIU). Within such devices the individual telephone line tip ring pairs are separated from the cable, individually connected to a connector block, and made available for further electrical connection and distribution. Usually there is a protector device inserted between the telephone and central office, or network side of the telephone line and the customer equipment or terminal side of the telephone line to protect the telephone and user, or other equipment connected to the telephone line, from hazardous overvoltages induced in the telephone network or in the cables passing between the telephone central office and the building within which the line is terminated.

In a typical arrangement, the telephone lines coming from the network are first wired to a protector field, which is an array of connectors for receiving the protector device, which is in turn hard wired to a first connector block which provides a first test point for testing the telephone line connections between the building and telephone central office. This first terminal block is hard wired to a multi pair connector, most typically a twenty-five pair connector of the RJ21 type, for further connection to an array of customer bridges which are also hard wired and connectorized via a mating RJ21 connector. The use of a customer bridge permits a subscriber to disconnect terminal equipment from a telephone line so that the subscriber can isolate troubles on the line as originating in the telephone network, or on the terminal equipment side of the telephone line.

Additionally, there are known insulation displacement connector (IDC) blocks for use in such junction boxes and/or distribution fields, such as the ubiquitous punch down connector block, also known as a 66-type connector block, and the tool-less insulation displacement connector blocks utilizing push cap connectors, such as that described in U.S. Pat. No. 4,913,659 dated Apr. 3, 1990, the entire disclosure of which is incorporated herein by reference. Such a connector block is commercially available under the product designation SC99 from Lucent Technologies Inc. Other connectors used for telephony wiring applications are described in U.S. Pat. No. 4,662,699 to Vachhani et al., dated May 5, 1987, and in U.S. Pat. No. 3,611,264 to Ellis, dated Oct. 5, 1971. Also available are tool-less IDC'S known as Mini-Rocker Connectors such as those sold by A. C. Egerton Ltd., which hold a tip-ring wire pair in terminals retained under a single movable cap through which both wires of the pair are inserted.

The tip and ring wires held within such tool-less IDC connectors are strain relieved only to the extent held by the compressive force exerted by the IDC terminal holding the bare wire which has been stripped of its insulation layer. While this prior art IDC works for its intended purpose, a significant drawback to this prior art IDC is that when a pulling force is applied to the tip or ring wire, the wire is easily stripped and disconnected from the terminal.

SUMMARY OF THE INVENTION

The present invention is directed at overcoming shortcomings in the prior art. Generally speaking, in accordance with the present invention, a strain relief mechanism for an insulation displacement connector comprises a cap section and a base section. The base section is connected to the cap section at a pivot point. The cap section has at least one wire insertion channel and a first wall. The wire insertion channel has an entrance aperture which is in fluid communication with an exit aperture for passage therethrough in an insertion direction of an inserted wire. The exit aperture is contained in the first wall. The cap section is pivotally moveable between an open position which facilitates insertion of the wire into the cap section through the entrance aperture and out through the exit aperture, and a closed position.

The base section has a side wall and a base hole or depression formed in the base section at the foot of the side wall. The base hole includes a wire stop portion at its bottom. The base hole is disposed such that passage of the inserted wire out through the exit aperture into the open portion of the base hole is limited by abutment against the wire stop portion at the bottom of the base hole. In this orientation, the wire is retained in the base hole at a first orientation which is substantially parallel to the insertion direction of the inserted wire. When the cap is moved into the closed position, the first wall of the cap section forces the wire into contact with the side wall so as to cause the wire to be bent and thus oriented at a wire bend angle in a second orientation. In this second orientation, the wire is restrained in the connector as a result of this forced bend and thereby is strain relieved.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DETAILED DESCRIPTION OF THE PREFERRED EMBODIMENTS

Figure 1:
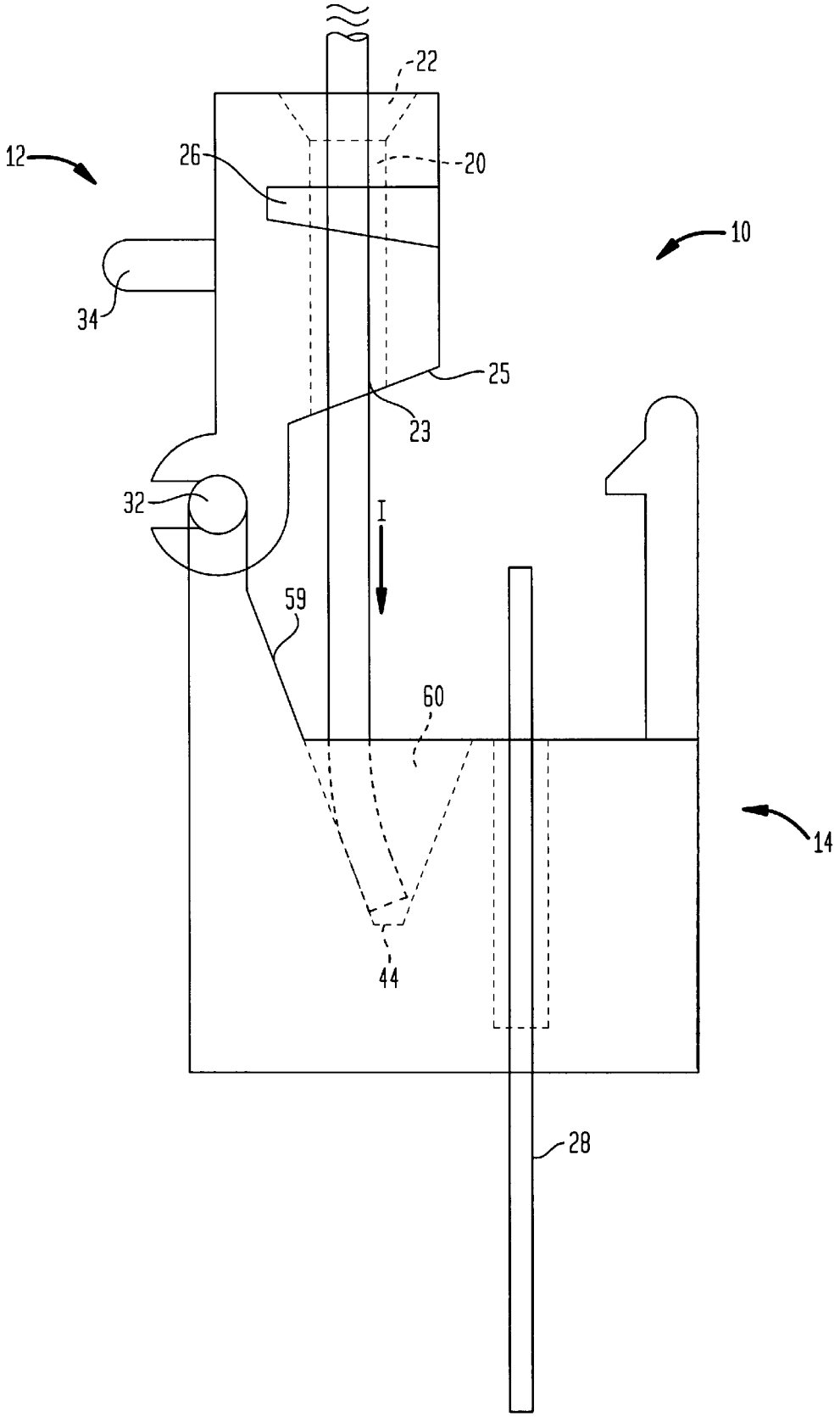
FIG. 1 is a side elevational view of a connector constructed in accordance with a preferred embodiment of the present invention with the cap section in the open position.
Figure 2:
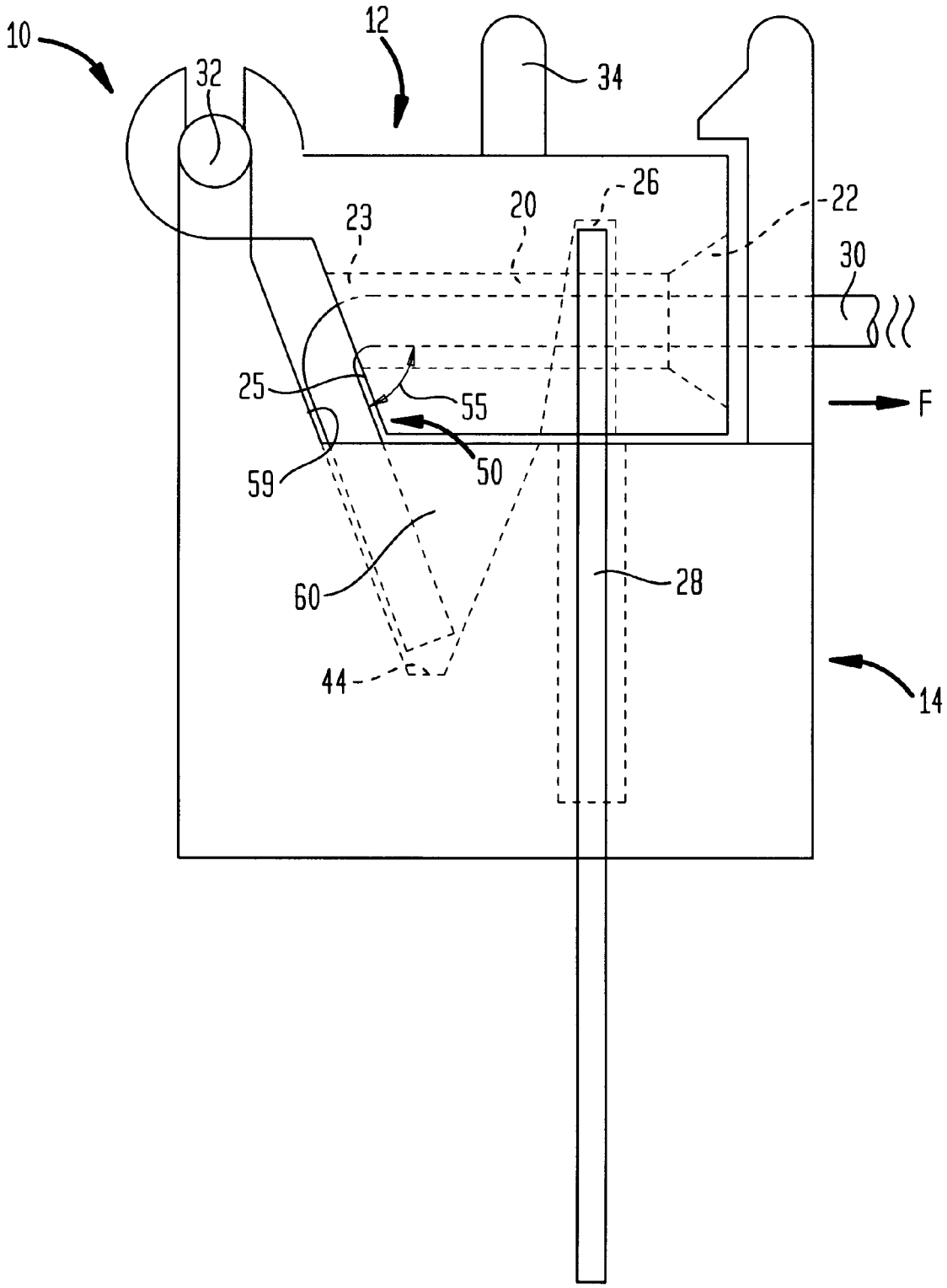
FIG. 2 is a side elevational view of the connector of FIG. 1 with the cap section in the closed position.

Reference is first made to FIGS. 1–2, which illustrate an insulation displacement connector of the present invention, generally indicated as 10. Connector 10 has a cap section, generally indicated as 12, and a base section, generally indicated as 14. Cap section 12 is connected to base section 14 at a preferably hinged pivot point 32. Cap section 12 pivots about pivot point 32 and is moveable between an open position, as illustrated in FIG. 1, and a closed position, as illustrated in FIG. 2. Base section 14 is preferably fixed to, for example, a connector block (not shown) or other mounting surface and includes at least one terminal strip 28.

Movement of cap section 12 between the open position and the closed position can be accomplished by the use of a finger grip member 34. Cap section 12 of connector 10 has at least one wire insertion channel 20. Generally, cap section 12 of connector 10 comprises two wire insertion channels 20, one for each wire of a tip-ring wire pair. Although the discussion here will focus on one wire insertion channel, cap section 12 of connector 10 may contain a plurality of wire insertion channels 20. Reference is now additionally made to FIG. 3, which illustrates a front elevational view of the connector of FIGS. 1–2, and shows that cap section 12 of connector 10 has two wire insertion channels 20. Each wire insertion channel 20 includes an entrance aperture 22 and an exit aperture 23. Entrance aperture 22 is in fluid communication with exit aperture 23. Exit aperture 23 is disposed on a first wall 25 of cap section 12. Entrance aperture 22 and exit aperture 23 allow for the passage, in an insertion direction I, of an inserted wire 30 through wire insertion channel 20 and beyond.

Positioning of cap section 12 in the open position facilitates the insertion of wire 30 into cap section 12 through entrance aperture 22 and out through exit aperture 23. Base section 14 includes a base hole 60 and a side wall 59. Base hole 60 includes a wire stop portion 44. Base hole 60 is disposed such that with cap section 12 in the open position, passage of wire 30 from exit aperture 23 guides wire 30 along side wall 59 into base hole 60. Entry of wire 30 into base hole 60 is limited by the abutment of wire 30 against wire stop portion 44. With cap section 12 in the open position, wire 30 is retained in base hole 60 at a first orientation which is substantially parallel to the direction of wire insertion discussed above. Base hole 60 is preferably tapered as shown so as to facilitate the bending of wire 30 at a predetermined bend angle discussed below. The designer of ordinary skill will, however, recognize that hole 60 can be formed of numerous shapes and sizes to meet application design-specific needs.

Figure 3:
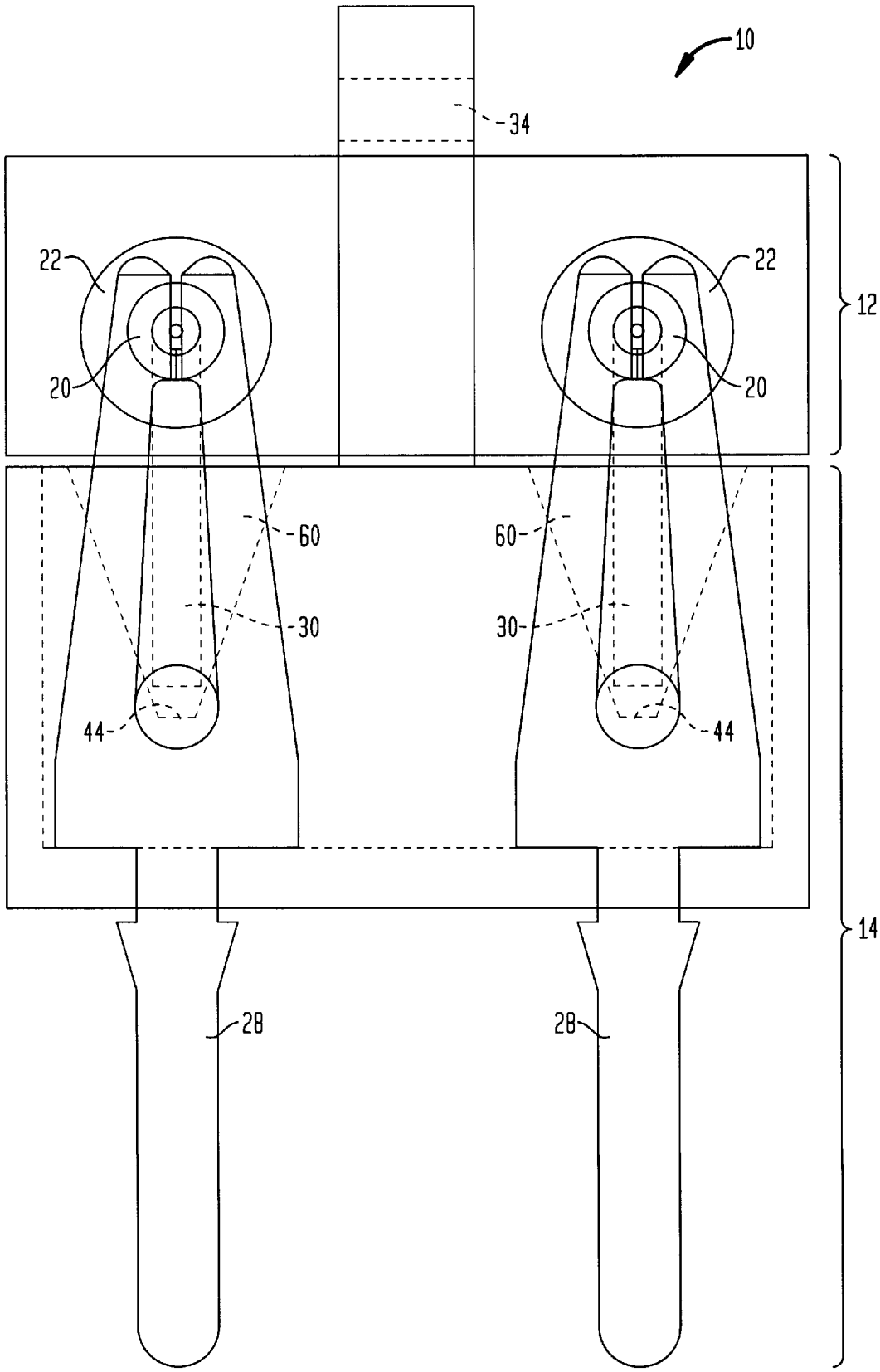
FIG. 3 is a front elevational view of the connector of FIG. 1 with the cap section in the closed position.

Cap section 12 of connector 10 also includes terminal strip receiving portions 26, which are constructed so as to be capable of receiving therein terminal strips 28 when cap section 12 is in the closed position, as illustrated in FIG. 2. When cap section 12 of connector 10 is in the open position, terminal strips 28 are not housed in terminal strip receiving portions 26 and do not intersect wire insertion channel 20. However, when cap section 12 is in the closed position, as illustrated in FIGS. 2–3, terminal strips 28 are housed in terminal strip receiving portions 26 and intersect wire insertion channel 20.

In use, wire 30 is generally passed through cap section 12 by inserting it in the insertion direction I (FIG. 1) into entrance aperture 22 and causing it to exit cap section 12 through exit aperture 23. When cap section 12 is in the open position, as shown in FIG. 1, exit aperture 23 substantially overlies base hole 60 of base section 14. Thus, wire 30 passing through entrance aperture 22 and exit aperture 23 can be guidedly received in base hole 60 by slidable, guided movement along side wall 59. Wire 30 can travel down side wall 59 into base hole 60 until it abuts against wire stop portion 44. When so inserted, wire 30 is positioned in base hole 60 at a first orientation as illustrated in FIG. 1. By slightly offsetting insertion channel 20 from base hole 60, a slight bend occurs in wire 30 as it slides down side wall 59, as shown in FIG. 1. This facilitates bending of wire 30, as discussed further below.

Reference is again made to FIG. 2 which depicts connector 10 with cap section 12 in the closed position. This closed position is achieved by pushing cap section 12 in a downward direction towards base section 14. Cap section 12 may be gripped at finger grip member 34 to facilitate the hinged pivoting movement of cap section 12. When cap section 12 is pushed into the closed position, wire 30 is driven into contact with terminal strip 28 whereupon it is stripped of insulation and mechanically and electrically coupled with terminal strip 28 within connector 10, in a manner known in the art (FIG. 3). In the closed position, terminal strips 28 are housed in terminal strip receiving portions 26, as best seen in FIG. 2.

Also, when cap section 12 is moved from the open position as illustrated in FIG. 1 to the closed position as illustrated in FIG. 2, first wall 25 of cap section 12 forces wire 30 into contact with side wall 59 of base section 14. This results in wire 30 being bent at a wire bend angle 55, as illustrated in FIG. 2. With cap section 12 of connector 10 in the closed position, the length of wire 30 contained within wire insertion channel 20 is disposed at a second orientation which is angled, at the wire bend angle 55, relative to the orientation of the length of wire 30 contained within base hole 60. The bending of wire 30 at bend angle 55 creates a strain relief on wire 30, resisting any pulling on wire 30 in the direction of force F, shown in FIG. 2.

In the closed position, first wall 25 preferably, although not necessarily, causes wire 30 to be pushed against side wall 59 of base section 14 at a pressure zone 50. The pressure applied by first wall 25 on wire 30 provides additional resistance to any pulling force that may be applied to wire 30. Thus, resistance to any pulling force on wire 30 is provided by the length of wire 30 contained between first wall 25 and side wall 59 in pressure zone 50, and not solely by the compressive force exerted by terminal strip 28 on the portion of wire 30 gripped thereby, as in prior art connectors. Pressure zone 50 fields the brunt of any pulling force that may be applied to wire 30. Consequently, the wire portion retained within terminal strip 28 is relieved from any strain which may result from the application of a pulling force F on wire 30 (FIG. 2). Thus, this mechanism provides for strong strain relief for connector 10. Alternatively, strain relief can be exclusively provided by the bending of wire 30 at bend angle 55, as discussed above.

Connector 10, along with cap section 12, is preferably, although not necessarily, designed in such a manner that wire 30 will break before it is released at pressure zone 50 and slides out of base hole 60, exit aperture 23, and entrance aperture 22. This provides for an efficient strain relief mechanism for connector 10. In a preferred embodiment, wire bend angle 55 of wire 30 is approximately equal to or less than 90°, although the person of skill will recognize that the precise angle 55, the length of wire 30 disposed in base hole 60, as well as the dimensions of wire insertion channel 20 and base hole 60, are a matter of application specific design requirements and are thus readily adaptable by the person of skill utilizing the teachings herein. Thus, wire bend angle 55 may be, for example, about 60° to about 120°.

Additionally, wire insertion channel 20 may be shaped and sized to provide additional retention of wire 30 through frictional engagement of wire 30 and the interior surface of wire insertion channel 20, provided that the friction introduced is not unduly high, so as to avoid the introduction of strain on wire 30 as cap section 12 of connector 10 is moved from the open position to the closed position.

Cap section 12 and base section 14 may be formed of any art-recognized material having the proper insulating and mechanical properties. Preferably, plastic is employed. The strain relieving mechanism of the present invention can be applied to a variety of connectors including Network Interface Device (NID) connectors and tool less IDC connectors. NID connectors normally face a great deal of wire tracing activities. Frequently, pulling forces applied on the wire during the wire tracing process causes the tip and ring wire to be dislodged from the IDC terminal strip. Consequently, the strain relief mechanism of the present invention helps prevent such dislodgment during the wire tracing process. Further, the strain relieved connector of the present invention may be used on a connector block wherein selective or all connectors on the connector block are strain relieved. Additionally, the connector of the present invention may be used in a wiring enclosure, such as a Building Entrance Protector (BEP) or a Network Interface Unit (NIU).

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A strain relief for a wire retained in an insulation displacement connector comprising:

a cap section having therein at least one wire insertion channel and a first wall, said insertion channel having an entrance aperture in fluid communication with an exit aperture for passage therethrough of said wire in an insertion direction, said first wall containing said exit aperture;

a base section connected to said cap section at a pivot point, said cap section being pivotally movable between an open position for facilitating insertion of said wire into said cap section through said entrance aperture and for passage out through said exit aperture toward said base, and a closed position;

said base section having a side wall and a base hole, said base hole including a wire stop portion, said base hole being disposed beneath said exit aperture when said cap is in said open position such that continued passage of said wire from said exit aperture causes said wire to pass into said base hole to an extent limited by abutment of said wire against said wire stop portion, said wire when passed to its fullest extent being positioned in said base hole at a first orientation substantially parallel to said insertion direction; and a portion of said first wall of said cap section forcing a first length of said wire into contact with said side wall when said cap section is moved into said closed position so as to cause said first length of wire to be bent in a second orientation at a wire bend angle relative to a second length of said wire extending within said insertion channel, said bend in said wire strain relieving said wire.

2. The strain relief of claim 1, wherein said wire is gripped in a pressure zone created by the squeezing of said wire between said first wall portion and a portion of said side wall when said cap section is in said closed position.

3. The strain relief of claim 1, wherein said insertion channel and said base hole are out of longitudinal alignment so as to facilitate bending of said wire when said cap section is in the closed position.

4. The strain relief of claim 1, wherein said base hole is tapered so as to facilitate the bending of said wire at a predetermined bend angle when said cap section is in the closed position.

5. The strain relief of claim 1, wherein said cap section includes a finger grip member for facilitating movement of said cap section from said open position to said closed position and vice versa.

6. The strain relief of claim 1, wherein said wire insertion channel is so sized and shaped as to introduce an amount of friction between said wire and a portion of said channel for providing additional strain relief.

7. The strain relief of claim 1, wherein said wire bend angle is approximately equal to 90°.

8. The strain relief of claim 1, wherein said wire bend angle is less than 90°.

9. The strain relief of claim 1, wherein said wire bend angle is more than 90°.

10. The strain relief of claim 1, wherein said wire bend angle is approximately equal to 75°.

11. The strain relief of claim 1, wherein said wire bend angle is in a range of about 60° to 120°.

12. The strain relief of claim 1, wherein said cap section comprises one or more terminal strip receiving portions.

13. The strain relief of claim 1, wherein said base section comprises one or more terminal strips.

14. The strain relief of claim 13, wherein said wire insertion channel intersects said terminal strip in said closed position.

15. The strain relief of claim 1, wherein said connector is an Network Interface Device connector.

16. The strain relief of claim 1, wherein said connector is disposed on a connector block.

17. The strain relief of claim 1, wherein said connector is disposed in a wiring enclosure.

18. An insulation displacement connector comprising:

a wire receiving cap section hingedly pivotally moveable between an open position and a closed position; and a base section having a cavity for receiving a portion of a wire passed from said cap into said cavity, said cap and said cavity being so sized and shaped that as said cap is moved from said open position to said closed position, said wire is caused to bend at a wire bend angle, said bend in said wire strain relieving said wire.

19. The insulation displacement connector of claim 18, wherein said wire bend angle is approximately equal to 90°.

20. The insulation displacement connector of claim 18, wherein said wire bend angle is less than 90°.

21. The insulation displacement connector of claim 18, wherein said wire bend angle is more than 90°.

22. The insulation displacement connector of claim 18, wherein said wire bend angle is approximately equal to 75°.

23. The insulation displacement connector of claim 18, wherein said wire bend angle is in a range of about 60° to 120°.

24. The insulation displacement connector of claim 18, wherein said connector is disposed on a connector block.

25. The insulation displacement connector of claim 18, wherein said connector is disposed in a wiring enclosure.

26. The insulation displacement connector of claim 18, wherein said connector is a Network Interface Device connector.

* * * * *